US008672783B2

(12) United States Patent
Fujikura et al.

(10) Patent No.: US 8,672,783 B2
(45) Date of Patent: Mar. 18, 2014

(54) SPORTS BALL

(75) Inventors: Takashi Fujikura, Hiroshima (JP); Masanobu Morishige, Hiroshima (JP); Shuzo Matsuno, Hiroshima (JP)

(73) Assignee: Mikasa Corporation, Hiroshima-shi, Hiroshima (JP)

( * ) Notice: Subject to any disclaimer, the term of this patent is extended or adjusted under 35 U.S.C. 154(b) by 0 days.

(21) Appl. No.: 13/407,979

(22) Filed: Feb. 29, 2012

(65) Prior Publication Data

US 2012/0231908 A1 Sep. 13, 2012

(30) Foreign Application Priority Data

Mar. 9, 2011 (JP) ..... 2011-051535

(51) Int. Cl.
*A63B 41/08* (2006.01)

(52) U.S. Cl.
USPC ..... 473/604; 473/607

(58) Field of Classification Search
USPC ..... 473/603–605, 598, 599, 607
See application file for complete search history.

(56) References Cited

U.S. PATENT DOCUMENTS

| | | | | |
|---|---|---|---|---|
| 2,280,314 | A * | 4/1942 | Scudder | 473/604 |
| 4,660,831 | A * | 4/1987 | Kralik | 473/603 |
| 5,752,890 | A * | 5/1998 | Shishido et al. | 473/599 |
| 6,206,795 | B1 * | 3/2001 | Ou | 473/599 |
| 6,302,815 | B1 * | 10/2001 | Shishido et al. | 473/604 |
| 6,503,162 | B1 * | 1/2003 | Shishido et al. | 473/605 |
| 6,726,583 | B1 * | 4/2004 | Lai | 473/605 |
| 7,066,853 | B2 * | 6/2006 | Chang | 473/605 |
| 7,749,116 | B2 * | 7/2010 | Tang et al. | 473/604 |
| 8,382,619 | B2 * | 2/2013 | Bulfin | 473/604 |
| 2003/0078119 | A1 * | 4/2003 | Shishido et al. | 473/605 |
| 2010/0160096 | A1 * | 6/2010 | Tang et al. | 473/607 |
| 2010/0167850 | A1 * | 7/2010 | Lin | 473/605 |
| 2010/0255940 | A1 | 10/2010 | Nuernberg et al. | |

FOREIGN PATENT DOCUMENTS

| | | | |
|---|---|---|---|
| EP | 0 705 624 | A1 | 4/1996 |
| JP | 2009-254636 | A | 11/2009 |
| JP | 2010-240427 | A | 10/2010 |

OTHER PUBLICATIONS

Machine translation of JP2009254636, retrieved May 24, 2013, pp. 1-17.*

European Patent Office, Extended European Search Report for European Patent Application No. 12 156 552.7, Dec. 5, 2013, Munich, Germany.

* cited by examiner

*Primary Examiner* — Steven Wong
(74) *Attorney, Agent, or Firm* — Taft Stettinius & Hollister LLP

(57) ABSTRACT

Surface panels of a sports ball are arranged to facilitate bending of their outer peripheral edge portions into an arc, without reducing strength of an elastic member, to define a groove at a seam between adjacent panels. Panels are adhered through the elastic members to a body defining a ball core with high adhesion strength. The panels have sheet material backed by an elastic member, each panel having an arched portion formed by bending inwardly an outer peripheral edge portion of each panel with a radius of curvature more than the thickness of the panel, after formation of many apertures in an inner peripheral edge portion of the elastic member. Lower edges of the arched portions of adjacent panels abut each other. A groove is defined at seams between adjacent panels, and the panels are adhered to a ball core body by adhering the elastic members to the body.

2 Claims, 4 Drawing Sheets

SPORTS BALL

This application claims priority of Japan Patent Application No. 2011-051535 filed on Mar. 9, 2011, which is incorporated by reference herein in its entirety. This invention relates to a sports ball such as a soccer ball, volleyball, a handball or the like, and particularly, to such a ball having surface panels of predetermined shapes adhered to a ball core referred to as a body.

BACKGROUND OF THE INVENTION

The surface panels on the ball of this type each comprise a sheet material, and an elastic member such as foamed material laminated to the sheet material on its back side to provide flexibility of the ball. Each surface panel is cut into a predetermined shape and the outer peripheral edge of the surface panel is inwardly bent by a forming process. The surface panels are adhered to the peripheral surface of the body and furthermore, the bent portions of the adjacent surface panels are also adhered on their side faces to each other to compensate for low peeling resistance of the elastic material from the body. However, it has been known in the art that the perfect adhesion of the side faces of the bent portions of the adjacent surface panels to each other is difficult, and in particular, in the case where pentagonal and hexagonal panels are combined on the body to fabricate a ball, adhesion of the bent portion side faces of the surface panels to each other is so difficult at points of intersection of the surface panels that the portions of the surface panels adjacent the points of intersection peel off. When an impact is exerted on the adhered bent portions of the adjacent surface panels in a radial direction towards the center of the sphere, weak adhesion results in destruction of the portions of the adjacent surface panels or release of the surface panels from the body.

It has been proposed that in order to increase surface area of the side faces of the bent portions of the adjacent surface panels, the peripheral edge portion of each of the surface panels is bent at about 90 degrees. This requires formation of slits or slots in or removal the portions of an elastic member adjacent the outer peripheral edge of the surface panel to facilitate bending the peripheral edge of the surface panel (refer to patent document 1). This has the disadvantage of decreasing strength of the portions of the elastic member adjacent the peripheral edge of the surface panel so that the adhesion of the elastic member to the body becomes weaker.

In addition, strength of adhesion of the adjacent surface panels to each other on their sides increases, but there is the disadvantage in that the flexibility of the ball is lost. Furthermore, since grooves at a seam of the adjacent surface panels become shallower, the trajectory of the ball's flight exhibits a behavior close to an aerodynamic character of a sphere having a smooth surface. For example, when reaching some speed, the trajectory of ball flight rapidly varies and exhibits a so-called abnormal movement.

Unlike the ball as described above, it has been proposed heretofore to define a groove at a seam of the adjacent surface panels attaching importance to the aerodynamic character. This is achieved by arching the peripheral edge portion of each of adjacent surface panels and adhering only the surface panels to a body without adhering the arched portions of the surface panels to each other (refer to patent document 2). With this arrangement, however, there is danger of the surface panels peeling from the ball body unless a high strength of adhesion is provided.

Patent document 1: Patent Application Publication 2009-254636

Patent document 2: Patent Application Publication 2010-240427

SUMMARY OF THE INVENTION

An object of the invention is to provide a sports ball comprising surface panels each having a sheet material backed by an elastic member, each of the surface panels being arranged to facilitate bending the outer peripheral edge portion into an arc shape without reducing strength of the elastic member so as to define a perfect groove at a seam of the adjacent surface panels, and the surface panels being capable of adhering through the elastic members to a body defining a ball core with higher strength of adhesion.

This object can be achieved by providing a sports ball comprising a plurality of surface panels each including a sheet material backed by an elastic member, each surface panel having an arched portion formed by bending inwardly an outer peripheral edge portion of each surface panel with a radius of curvature longer than the thickness of the surface panel after forming a number of apertures in an inner peripheral edge portion of the elastic member, the lower edges of the arched portions of the adjacent surface panels abutting each other so that a groove is defined at a seam of the adjacent surface panels, the body defining a ball core being covered with the surface panels by adhering their elastic members to the body.

Because the many apertures in the inner peripheral edge portion of the elastic member of each of the surface panels make movement of the panel material easier when the outer peripheral portion of the surface panel is bent to form the arched portion, the arched portion of the surface panel ensures to maintain its shape after bending thereof. Due to the fact that the arched portion of the surface panel has the radius of curvature longer than the thickness of the surface panel, a deep and perfect groove is defined at the seam of the adjacent surface panels when the body is covered with the surface panels. A portion of the adhesive, with which the surface panels are adhered through its elastic member to the body, penetrates the many apertures and solidifies there to provide strong adhesion of the panel portion to the body.

DETAILED DESCRIPTION OF THE PREFERRED EMBODIMENT

Figure 1:
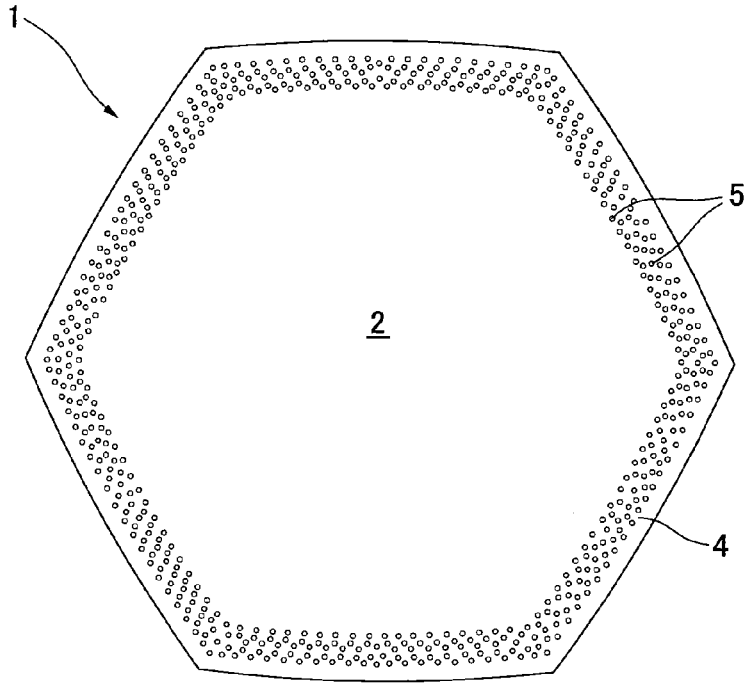
FIG. 1 is a bottom plan view of one of the surface panels to be adhered to a ball core of a sports ball according to the invention.
Figure 2:
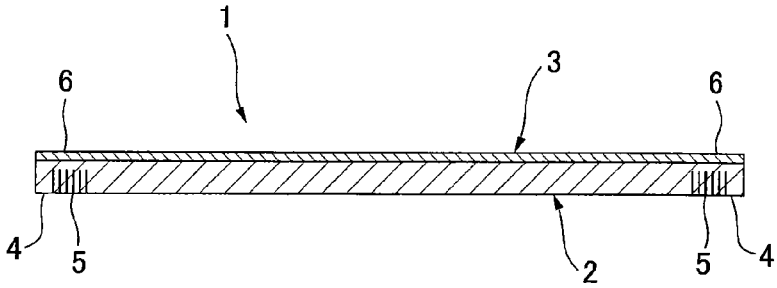
FIG. 2 is view showing in section the surface panel in FIG. 1.

Referring to FIGS. 1 and 2 in the accompanying drawings, surface panels 1 each comprises a sheet material 3 backed by an elastic member 2 of foam material and has a predetermined shape, for example, a hexagonal shape as shown. Since in a soccer ball, surface panels having hexagonal and pentagonal shapes are used in combination, it is apparent that the pentagonal surface panels are also subjected to the same process as in the hexagonal surface panels. The sheet material 3 preferably comprises urethane resin having wear resistance and water resistance, but synthetic rubber, polyester elastomer, and polyvinyl chloride may be used for the sheet material. The elastic member 2 may be of rubber, polyurethane, polyvinyl chloride, polyvinyl alcohol, polystyrene, polyester elastomer, ethylene-vinyl acetate, or their foam, or nonwoven fabric.

Figure 3:
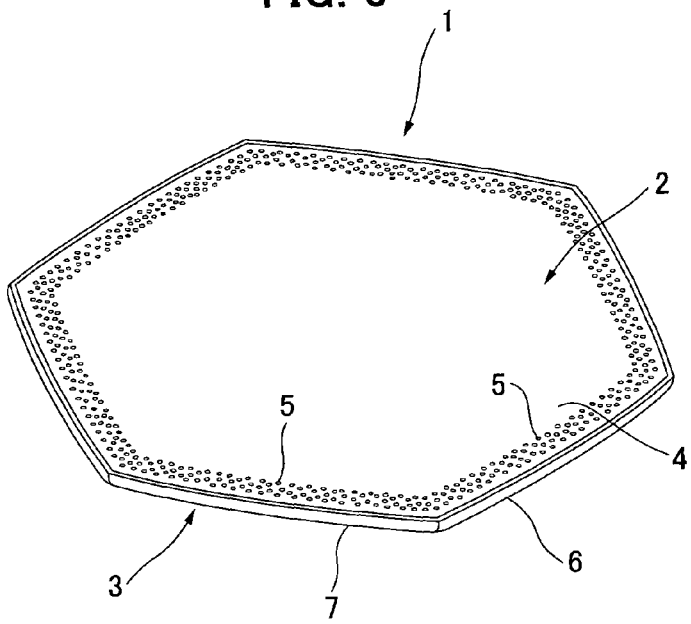
FIG. 3 is a perspective view of the surface panel after forming.
Figure 4:
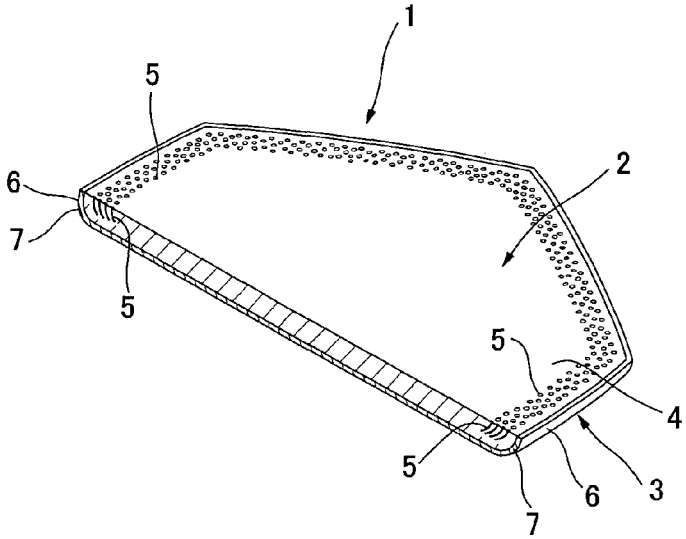
FIG. 4 is a perspective view of the surface panel in FIG. 3, viewed from its bottom but showing in section a portion of the surface panel.
Figure 5:
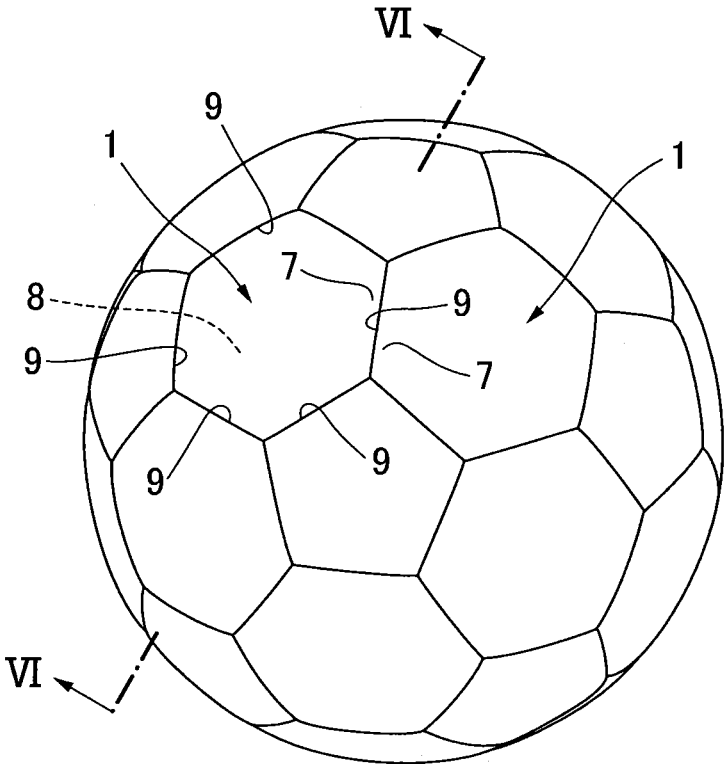
FIG. 5 is a perspective view of the sports ball according to the invention with the surface panels adhered to the body.

As can be seen in FIGS. 3 and 4, the elastic member 2 of each of the surface panels 1 has a number of apertures 5 formed in an inner peripheral edge portion 4 thereof without penetrating through elastic member 2. After formation of the apertures, outer peripheral edge portion 6 of each surface panel 1 is bent inwardly to form an arched portion 7. The formation of the arched portion of each surface panel is preferably carried out by a thermoforming process. The arched portion 7 of the surface panel 1 preferably has a radius of curvature longer than the thickness of the surface panel 1 so that the arched portions 7 of the adjacent surface panels 1 define a deep and perfect groove 9 at a seam of the adjacent surface panels 1, as shown in FIGS. 5 and 6, when the surface panels 1 are adhered through their elastic members to a body 8 defining a ball core as described below.

Prior to the forming process of surface panels, apertures 5 are formed in elastic member 2 in an area of about 8 mm to about 10 mm from an outer peripheral edge of each of the surface panels in rows and at random. Since the many apertures make movement of the panel material easier when bending inwardly the outer peripheral edge portion 6 of the surface panel, the apertures serve to facilitate bending the outer peripheral edge portion 6 of the surface panel and are useful in maintaining the arc shape of the arched portion of the panel.

Figure 6:
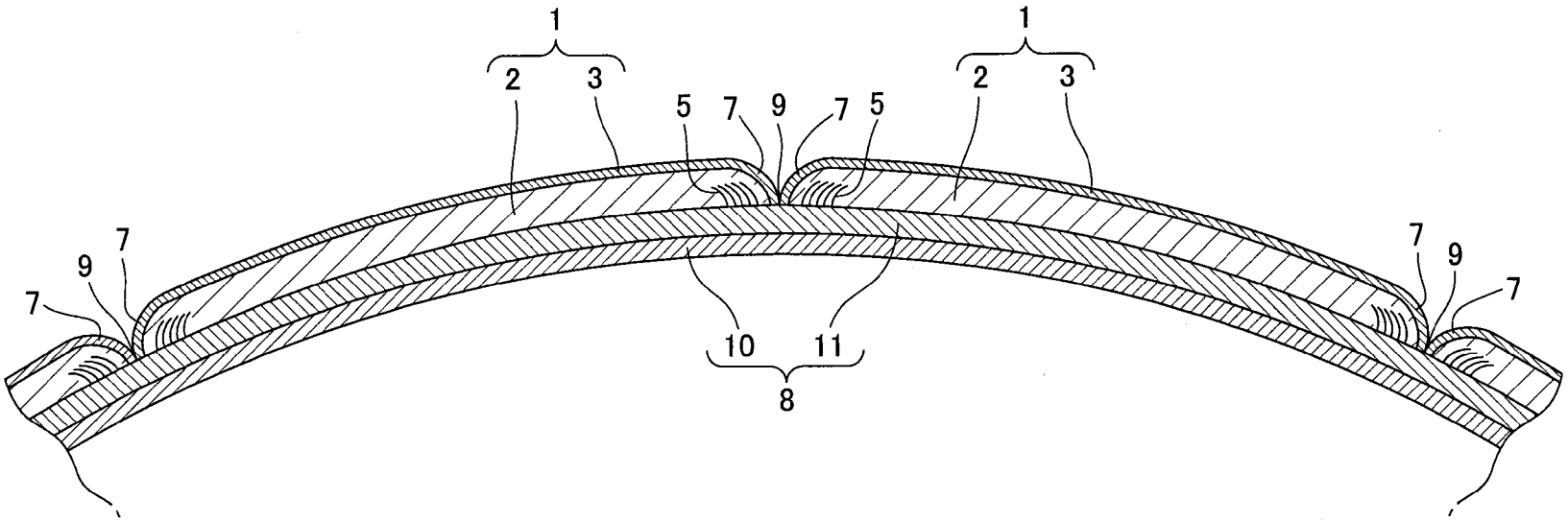
FIG. 6 is a cross section of the ball taken along line VI-VI in FIG. 5.

As shown in FIG. 6, the body comprises a rubber bladder 10, and a reinforcing layer 11, and is completed by inflating the bladder with air. The surface panels are secured on the body by adhering only the elastic member 2 to the body 8, and at this point, the lower edges of the arched portions 7 abut each other to define a groove 9 at a seam of the adjacent surface panels.

Since according to the invention, the arched portions of the adjacent surface panels have longer radius of curvature, significant grooves are defined between the adjacent surface panels to provide an improvement in aerodynamic character of the ball as compared with shallow grooves in a conventional ball, and a stable trajectory of flight of the ball. A portion of adhesive between the elastic members of the surface panels and the body penetrates the many apertures and solidifies in the elastic members to provide strong adhesion there, instead of not adhering the arched portions to each other.

What we claim:

1. A sports ball comprising:

a body defining a ball core; and a plurality of surface panels, wherein said surface panels each include a sheet material backed by an elastic member, and are adhered to said body with adhesive between said elastic member and said body so that said body is covered with the surface panels, each surface panel has an arched portion bent inwardly on an outer peripheral edge portion of each surface panel with a number of generally radially extending apertures formed in an inner peripheral edge portion of the elastic member, said arched portion has a radius of curvature longer than the thickness of the surface panel, so that the lower edges of the arched portions of the adjacent surface panels abut each other to define a groove reaching said body at a seam of the adjacent surface panels, and a portion of said adhesive penetrates said apertures to provide strong adhesion there.

2. A sports ball according to claim 1, wherein, prior to the forming of surface panels, the apertures are formed in the elastic member in an area of about 8 mm to about 10 mm from an outer peripheral edge of each of the surface panels, in rows and at random.

* * * * *